United States Patent [19]

Goto et al.

[11] 4,027,635

[45] June 7, 1977

[54] FLOW RATE CONTROL MECHANISM FOR USE IN EXHAUST GAS RE-CIRCULATING SYSTEM

[75] Inventors: Kenji Goto; Norio Shibata; Yukihide Hashiguchi, all of Susono, Japan

[73] Assignee: Toyota Jidosha Kogyo Kabushiki Kaisha, Toyoda, Japan

[22] Filed: Apr. 8, 1975

[21] Appl. No.: 566,678

[30] Foreign Application Priority Data

Sept. 25, 1974 Japan ..... 49-110282

[52] U.S. Cl. ..... 123/119 A

[51] Int. Cl.[2] ..... F02M 25/06

[58] Field of Search ..... 123/119 A

[56] References Cited

UNITED STATES PATENTS

| | | | |
|---|---|---|---|
| 3,304,711 | 2/1967 | Eastman | 123/119 A |
| 3,397,682 | 8/1968 | Riggan | 123/119 A |
| 3,435,810 | 4/1969 | Busse | 123/119 A |
| 3,566,610 | 3/1971 | Fiore | 123/119 A |
| 3,672,340 | 6/1972 | Bomba | 123/119 A |
| 3,744,251 | 7/1973 | Hallum | 123/119 A |
| 3,817,232 | 6/1974 | Nakajima et al. | 123/119 A |
| 3,866,585 | 2/1975 | Kopa | 123/119 A |
| 3,890,945 | 6/1975 | Goto et al. | 123/119 A |

*Primary Examiner*—Wendell E. Burns
*Attorney, Agent, or Firm*—Stevens, Davis, Miller & Mosher

[57] ABSTRACT

A flow rate control mechanism for use in controlling the flow rate of exhaust gases in an exhaust gas re-circulating system of an internal combustion engine. This mechanism includes a swirl flow chamber having a circular cross section, a first nozzle and a second nozzle, the former of which is open through the inner wall of the swirl flow chamber therein in the direction normal thereto and the latter of which is open through inner wall of the swirl flow chamber therein in the direction tangential thereto. The latter nozzle is positioned close to the opening of the former or first nozzle. The first nozzle directed in the normal direction extracts part of exhaust gases through an exhaust manifold, while the second nozzle directed in the tangential direction is communicated with atmosphere. The opening of the first nozzle is close to the opening of the second nozzle, so that the pressure at the opening of the first nozzle approximates the atmospheric pressure. As a result, the flow rate of exhaust gases which having been extracted through the exhaust manifold and fed into the flow rate control mechanism will be proportional to the square root of the exhaust gas pressure. On the other hand, the flow rate of intake air will be proportional to the square root of the exhaust gas pressure. Thus, the exhaust gases at a flow rate proportional to that of intake air is introduced into the swirl flow chamber, so that the both gases are mixed therein and fed into an intake manifold.

6 Claims, 8 Drawing Figures

FLOW RATE CONTROL MECHANISM FOR USE IN EXHAUST GAS RE-CIRCULATING SYSTEM

BACKGROUND OF THE INVENTION

This invention relates to a EGR system or a system for use in re-circulating part of exhaust gases to the air intake side for reducing the amount of nitrogen oxide (NO*x*) which is a harmful component of exhaust gases from an internal combustion engine, and more particularly to a flow rate control mechanism for controlling the flow rates of re-circulating exhaust gases and air to be taken into the engine.

Hitherto, it has been a common practice in the exhaust gas-recirculating system of an internal combustion engine to use a mechanically operating mechanism consisting of a combination of a diaphragm and a valve mechanism for obtaining re-circulating exhaust gases at a flow rate commensurate to the flow rate of intake air. However, such a mechanically operating mechanism meets only a partial success, suffering from disadvantages such as complicated constuction, hence high manufacturing cost and increasing man power, with the accompanying inaccurate operation of a diaphragm resulting from various unfavorable conditions such as vibration and environmental temperature, and thus there remains a reliability problem to be solved.

SUMMARY OF THE INVENTION

It is accordingly a principal object of the present invention to provide a flow rate control mechanism for use in an exhaust gas re-circulating system by avoiding the aforesaid drawbacks i.e., by re-circulating exhaust gases at a flow rate proportional to the flow rate of air being taken into an engine.

It is another object of the present invention to provide a flow rate control mechanism in an exhaust gas re-circulating system, which mechanism is devoid of complicated mechanical movable portions and controls the flow rate of exhaust gases being re-circulated, according to a hydrodynamic principle.

It is a further object of the present invention to provide a flow rate control mechanism for use in an exhaust gas re-circulating system, which mechanism is simple in construction and positive in operation in controlling the flow rate of exhaust gases being re-circulated.

According to the present invention, there is provided for achieving the aforesaid objects a flow rate control mechanism for use in an exhaust gas re-circulating system, which mechanism includes a swirl flow chamber having a circular cross section and an opening provided at one end for communication with an intake manifold of an internal combustion engine and the other end closed. The swirl flow chamber is provided with a first nozzle which is open therein in the direction normal to the inner wall of the swirl flow chamber and a second nozzle which is positioned close to the first nozzle and open therein in the direction tangential to the inner wall of the swirl flow chamber. The first nozzle or a nozzle which is directed in the normal direction is communicated with an exhaust manifold of an engine, while the second nozzle or a nozzle which is directed in the tangential direction is communicated with atmosphere. Since the intake air being fed into the engine passes through the second nozzle or a nozzle directed in the tangential direction, the pressure prevailing at the opening of the second nozzle or a nozzle which is directed in the normal direction is substantially equal to the atmospheric pressure. As a result, the flow rate of exhaust gases which have been extracted through an exhaust manifold to be introduced into the swirl flow chamber will be proportional to the square root of the exhaust gas pressure in the exhaust manifold, irrespective of the negative pressure of intake air. On the other hand, the flow rate of intake air into an engine is proportional to the square root of the pressure of exhaust gases in the exhaust manifold. It follows then that the exhaust gases at a flow rate proportional to that of intake air may be extracted through the exhaust manifold for re-circulation. In other words, the flow rate of the exhaust gases being extracted through the exhaust manifold is controlled due to the flow rate of intake air.

These and other objects and features of the present invention will be apparent from a reading of the ensuing part of the specification which indicate the embodiments of the invention.

DESCRIPTION OF THE PREFERRED EMBODIMENTS

Figure 1:
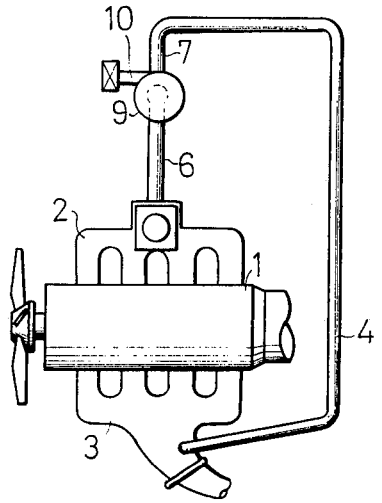
FIG. 1 is an outline of a control mechanism for use in an internal combustion engine.

Description will now be given of one embodiment of the present invention by referring to FIGS. 1 through 4. A pipe 4 is adapted to extract therethrough part of exhaust gases for re-circulation through an exhaust manifold 3 of an internal conbustion engine 1. The pipe 4 is communicated with an exhaust gas intake port 7 of a flow control mechanism according to the present invention, while an exhaust port 12 of the flow rate control mechanism 5 is communicated by way of a pipe 6 with an intake manifold 2 of the internal combustion engine 1.

Figure 2:
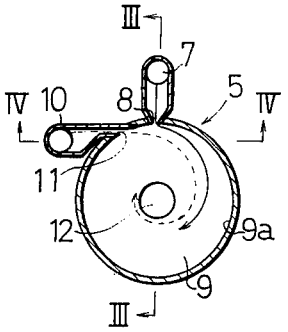
FIG. 2 is a cross sectional view of the control mechanism, taken along the line II—II of FIG. 3.
Figure 3:
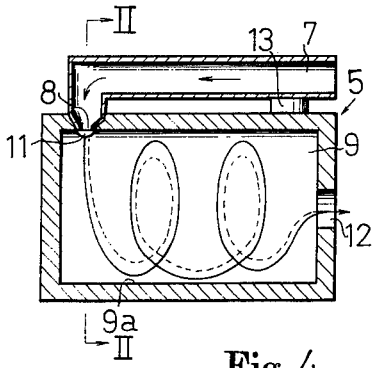
FIG. 3 is a cross sectional view taken along the line III—III of FIG. 2.
Figure 4:
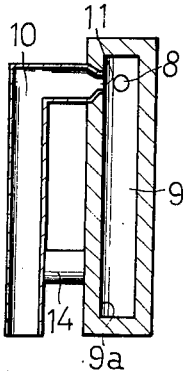
FIG. 4 is a cross sectional view taken along the line IV—IV of FIG. 2.

Referring to FIGS. 2 through 4 which show the flow rate control mechanism 5 of the invention, the control mechanism 5 includes a swirl flow chamber 9 having a substantially circular cross section. The exhaust gas intake port 7 which is adapted to introduce the re-circulating exhaust gases therethrough is communicated with a first nozzle 8 which is open through the inner wall surface 9*a* of the swirl flow chamber 9 therein in the direction normal to the surface 9*a*, while atmosphere intake port 10 which is adapted to introduce atmosphere therethrough is communicated with a second nozzle 11 which is open through the inner wall surface 9*a* of the swirl flow chamber 9 therein in the direction tangential to the surface 9*a*. The nozzles 8 and 11 are positioned close to each other and communicated with the swirl flow chamber 9. On the other hand, the exhaust port 12 through which mixture of air and re-circulating exhaust gases is fed into the intake manifold 2 is positioned in the center of the chamber 9, as viewed in the longitudinal direction thereof.

Description will now be turned to the operation of the control mechanism 5 of the aforesaid arrangement. Assume that the pressure (P*e*) of re-circulating exhaust gases through a pipe 4 acts on the exhaust gas intake port 7, the atmospheric pressure (P*o*) acts on the atmosphere intake port 10, and the negative pressure of intake air in the intake manifold 2 acts on the exhaust port 12 by way of the pipe 6, respectively. As has been described earlier, the exhaust gas intake port 7 is communicated with the first nozzle 8 and the atmosphere intake port 10 is communicated with the second nozzle 11, while the nozzles 8 and 11 are positioned close to each other and both communicated with the swirl flow chamber 9, so that the pressure close to atmospheric pressure prevails in the neighborhood of the first nozzle 8.

Meanwhile, the exhaust gas pressure (P*e* mmHg) in the exhaust manifold 3 and the flow rate of recirculating exhaust gases (G*e*, gr/sec) are given in the following formula;

$$Ge = \gamma_1 \cdot \alpha \cdot A \cdot \sqrt{2g\,(P_1 - P_2)}\,/r_1 \qquad \text{(a)}$$

wherein $\gamma_1$, $\alpha$, $A$: constants $P_1$: gas pressure upstream of the nozzle 8

$P_2$: gas pressure downstream of the nozzle 8.

As a result, the formula (a) is expressed by $GE \propto \sqrt{P_1 - P_2}$.

On the other hand, the pressure ($P_2$) is substantially equal to atmospheric pressure ($Po$), so that $P_1 - P_2 = Pe$, thus $$Ge \propto \sqrt{Pe} \qquad \text{(b)}$$

Figure 5:
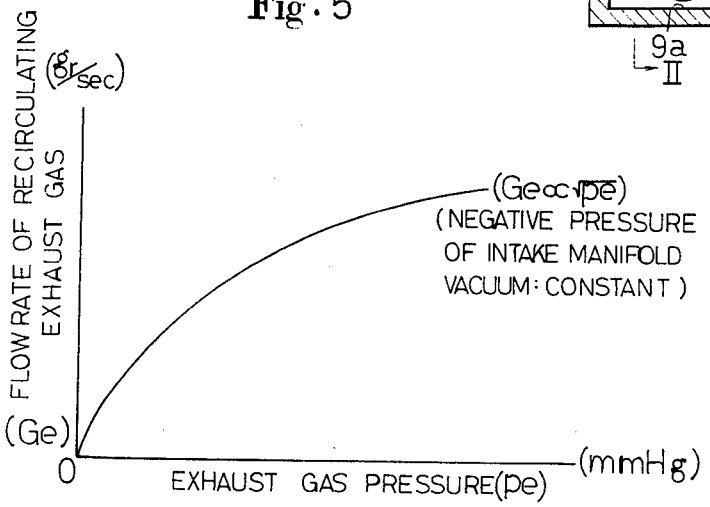
FIG. 5 is a plot showing the relationship between the flow rate (G*e*) of re-circulating exhaust gases and the pressure (P*e*) of exhaust gases, when the intake air negative pressure is maintained constant.
Figure 6:
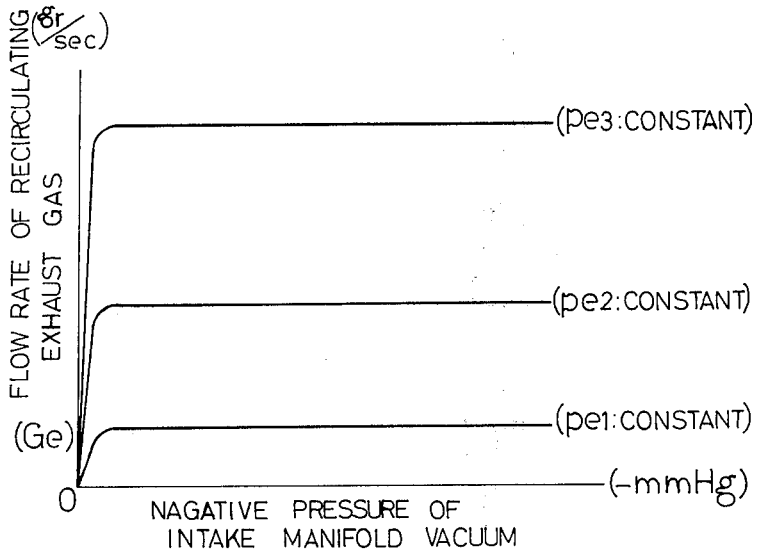
FIG. 6 is a plot illustrating the relationship between the flow rate (G*e*) of re-circulating exhaust gases and the negative pressure of intake air, with the pressure of the exhaust gases being taken as a parameter.

Next, the relationship between the negative pressure of intake air and the flow rate of re-circulating exhaust gases (G*e*) is determined by taking the exhaust gas pressure (P*e*) as a parameter so the plot as shown in FIG. 6 may be obtained. Accordingly, the relationship given in a graph shown in FIG. 5, i.e., formula (b) may be maintained irrespective of the variation in the negative pressure of intake air, so that the re-circulating exhaust gas at a flow rate (G*e*), which is proportional to the square root of the pressure of exhaust gases (P*e*), will be introduced into the exhaust gas intake port 7.

Next, the relationship between the exhaust gas pressure (P*e*) and the flow rate of air (G*a*) to be introduced in the atmosphere intake port 10 is expressed by the following formula:

$$Pe = a \cdot Ga^2 \qquad \text{(c)}$$

wherein *a* represents a constant. Accordingly, $$Ga \propto \sqrt{Pe} \qquad \text{(d)}$$

Thus, air at a flow rate (G*a*), which is proportional to the square root of the exhaust gas pressure (P*e*), will be introduced into the atmosphere intake port 10.

According to the formulae (b) and (d), $$Ge \propto \sqrt{Pe} \propto Ga \qquad \text{(e)}$$

It follows from this that the re-circulating exhaust gases at a flow rate (G*e*) proportional to the flow rate of air (G*a*) may be introduced from the atmosphere intake port 10 through the exhaust gas intake port 7 into the swirl flow chamber 9. the above two fluids are mixed therein and fed from the exhaust port 12 through the pipe 6 into the intake manifold 2.

Figure 7:
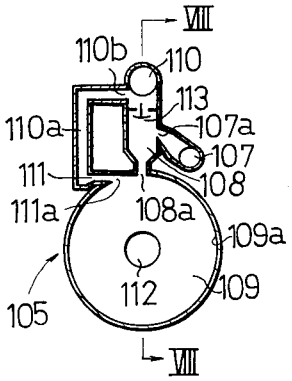
FIG. 7 is a cross sectional view of a control mechanism embodying the present invention, taken along the line VII—VII of FIG. 8.
Figure 8:
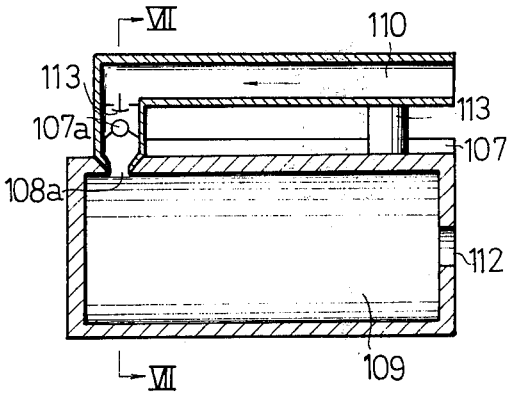
FIG. 8 is a cross sectional view taken along the line VIII—VIII of FIG. 7.

FIGS. 7 and 8 are illustrative of another embodiment 105 of the present invention. In this embodiment 105, an atmosphere intake port 110 is communicated with a first nozzle 108 which is open through an inner wall surface 109*a* of a swirl flow chamber 109 therein in the direction normal to the surface 109*a* and communicated with a branched passage 110*a* of the first nozzle 108. The branched passage 110*a* is communicated at its one end with a second nozzle 111 which is open through the inner wall surface 109*a* of the swirl flow chamber 109 therein substantially in the direction tangential to the surface 109*a*. In this respect, the openings 108*a*, 111*a* of the nozzles 108 and 111 in the swirl flow chamber 109, respectively, are closely positioned to each other. The nozzle 107*a* communicating with exhaust gas intake port 107 is open in the inner cavity of the first nozzle 108 between the entrance 110*b* of the branched passage 110*a* and the opening 108*a*which is open into the swirl flow chamber 109. In addition, there is provided a check valve 113 within the inner cavity of the nozzle 108 in the position between the exit of the nozzle 107*a* and the entrance 110*b* of the branched passage 110*a*. In this embodiment, as well, the pressure close to atmospheric pressure prevails in the neighborhood of the opening 108*a*of the first nozzle 108, which is open into the swirl flow chamber 109.

In operation, in case the exhaust gas pressure (P*e*) is high, the check valve 113 is closed due to the gas pressure, thereby preventing the reverse flow of exhaust gases to the side of atmosphere. At this time, air from the atmosphere intake port 110 is introduced through the branched passage 110*a* into the swirl flow chamber 109, as in the case of the previous embodiment, thereby bringing the flow rate of intake air flowing into the swirl flow chamber 109 and the flow rate of the re-circulating exhaust gases into proportion to each other. On the other hand, in case the exhaust gas pressure (P*e*) is low, the check valve 113 is opened, with the result that air is introduced through the atmosphere intake port 110 and the nozzle 108 and then into the swirl flow chamber 109, together with the re-circulating exhaust gases through the exhaust gas intake port 107. As a result, the flow rate of the intake air into the swirl flow chamber 109 and the flow rate of the re-circulating exhaust gases are brought into proportion to each other.

While the present invention has been described herein with reference to certain exemplary embodiments thereof, it should be understood that various changes, modifications and alterations may be effected without departing from the spirit and the scope of the present invention, as defined in the appended claims.

What is claimed is:

1. A flow rate control mechanism for use in an exhaust gas re-circulating system, comprising:

a swirl flow chamber having a circular cross section, said chamber having one end closed and a port at the other end, as viewed in the longitudinal direction of said chamber, said port being communicated with an intake of an internal combustion engine;

a first nozzle for use in introducing exhaust gases in said chamber, said first nozzle being open to said chamber therein in a direction normal to the axis of said circular cross section; and a second nozzle for use in introducing atmospheric air only into said chamber, said second nozzle being adjacent said first nozzle and being open circular cross section to said chamber in a direction substantially tangential to said circular cross section.

2. A flow rate control mechanism as set forth in claim 1, wherein said mechanism is made of a single block.

3. A flow rate control mechanism for use in an exhaust gas re-circulating system, comprising:

a swirl flow chamber having a circular cross section, said chamber having one end closed and a port at the other end, as viewed in the longitudinal direction of said chamber, said port being communicated with an intake manifold of an internal combustion engine;

a first nozzle for introducing atmosphere, said first nozzle being open at one end in said swirl flow chamber through the inner wall surface of said chamber in the direction normal to said surface and communicated at the other end with an atmosphere intake port as well as an exhaust gas intake port downstream of said atmosphere intake port;

a second nozzle positioned in a branched passage, said second nozzle being communicated at its one end with said first nozzle between the position of said first nozzle communicating with said atmosphere intake port and the opening position of said exhaust gas intake port, said second nozzle being open at the other end through the inner wall surface of said chamber therein in the direction tangential to said surface but in the position close to the opening of said first nozzle in said chamber; and means for preventing the ingress of exhaust gases into said second nozzle in said branched passage, when the pressure of exhaust gases is high, said means being provided within said first nozzle for use in introducing atmosphere, between the opening position of said second nozzle and the opening position of said exhaust gas intake port.

4. A flow rate control mechanism as set forth in claim 3, wherein said means for preventing the ingress of said exhaust gases into said second nozzle in said branched passage comprises a check valve.

5. A flow rate control mechanism for an exhaust gas recirculating system in an internal combustion engine, said mechanism comprising:

means defining a swirl flow chamber having a circular cross-section and disposed in an intake system of the engine, said chamber having a first inlet port for atmospheric air only, said first port opening into said chamber in a direction substantially tangential to the circular periphery of said chamber, a second inlet port for exhaust gas located adjacent said first inlet port and in fluid communication with an exhaust manifold of the engine, said second port opening into said chamber in a direction substantially normal to the axis of the circular periphery of said chamber, and an outlet port in fluid communication with an intake manifold of the engine through which a mixture of the air and the exhaust gas is fed to the engine.

6. A flow rate control mechanism as claimed in claim 5, wherein:

said means comprises a cylinder having said chamber defined therein, said cylinder having a pair of end walls, one of said walls being closed and the other of said walls having said outlet port defined therein.

* * * * *